US009631338B2

(12) United States Patent
Kusuma et al.

(10) Patent No.: US 9,631,338 B2
(45) Date of Patent: Apr. 25, 2017

(54) REINFORCED EARTH

(75) Inventors: Surya Kusuma, Singapore (SG); Mario Müggler, Oensingen (CH)

(73) Assignee: VSL INTERNATIONAL AG, Köniz (CH)

( * ) Notice: Subject to any disclaimer, the term of this patent is extended or adjusted under 35 U.S.C. 154(b) by 40 days.

(21) Appl. No.: 14/401,635

(22) PCT Filed: May 22, 2012

(86) PCT No.: PCT/EP2012/059510

§ 371 (c)(1),
(2), (4) Date: Nov. 17, 2014

(87) PCT Pub. No.: WO2013/174419

PCT Pub. Date: Nov. 28, 2013

(65) Prior Publication Data

US 2015/0159340 A1 Jun. 11, 2015

(51) Int. Cl.

| | |
|---|---|
| ***E02D 29/02*** | (2006.01) |
| ***E02D 5/80*** | (2006.01) |
| ***E02D 31/10*** | (2006.01) |

(52) U.S. Cl.

CPC ..... *E02D 29/0233* (2013.01); *E02D 5/80* (2013.01); *E02D 29/0241* (2013.01); *E02D 31/10* (2013.01)

(58) Field of Classification Search

CPC . E02D 29/0233; E02D 29/0241; E02D 31/10; E02D 5/80; E02D 5/74;

(Continued)

(56) References Cited

U.S. PATENT DOCUMENTS 3,848,367 A * 11/1974 Barnes ..... B60P 3/36 52/157
3,937,436 A * 2/1976 Stewart ..... E04B 1/34347 248/499

(Continued)

FOREIGN PATENT DOCUMENTS

| | | | |
|---|---|---|---|
| GB | 2364729 | A | 2/2002 |
| WO | WO0238872 | A1 | 5/2002 |
| WO | WO03004781 | A1 | 1/2003 |

OTHER PUBLICATIONS

International Search Report and Written Opinion dated Mar. 11, 2013 for PCT/EP2012/059510.

*Primary Examiner* — John Kreck
*Assistant Examiner* — Carib Oquendo
(74) *Attorney, Agent, or Firm* — Pearne & Gordon LLP

(57) ABSTRACT

The present invention concerns a method of installing a reinforcement strip in a compacted fill retained by facing element together with the reinforcement strip extending between an anchorage zone and the wall. The anchorage zone is located away from the facing element and separated from the facing element. The method comprises: a) installing the reinforcement strip in the fill by feeding the strip from a first location in the anchorage zone to the wall and looping the strip through a wall connection point back to a second location in the anchorage zone; b) tensioning the strip by pulling the strip to a predetermined tension at the first location and at the second location; and c) anchoring the strip to the fill at the first location and at the second location while keeping the strip under tension.

15 Claims, 12 Drawing Sheets

(58) Field of Classification Search
CPC .. E02D 5/76; E02D 5/18; E02D 5/187; E02D 5/54; E02B 3/04; E02B 3/06; B25B 25/00
See application file for complete search history.

(56) References Cited

U.S. PATENT DOCUMENTS

| | | | | |
|---|---|---|---|---|
| 4,343,571 | A * | 8/1982 | Price | E02D 29/0241 405/284 |
| 4,728,227 | A * | 3/1988 | Wilson | E02D 29/0241 405/262 |
| 6,371,699 | B1 * | 4/2002 | Weinreb | E02D 29/0233 405/262 |
| 6,848,674 | B2 * | 2/2005 | Lee | E02D 29/0241 254/262 |
| 6,928,783 | B2 * | 8/2005 | Oliver | E02D 5/801 52/149 |
| 2003/0223825 | A1 | 12/2003 | Timmons et al. | |
| 2007/0009331 | A1 * | 1/2007 | Lee | E02D 29/025 405/262 |

* cited by examiner

REINFORCED EARTH

TECHNICAL FIELD

The present invention relates to a method of installing and tensioning reinforcement elements, such as polymeric strips, in earth retaining structures. The invention also relates to a corresponding apparatus capable of carrying out the method and to assemblies used for anchoring the strip to the earth.

BACKGROUND OF THE INVENTION

Retained earth systems are composite soil reinforcing systems that usually use welded wire mesh, steel strips, geogrids or polymeric strips to resist the horizontal forces generated within an earth backfill and to create a stable earth block for a retaining wall and steep slope construction. The basic retained earth principle involves transferring stresses from the soil to the reinforcing elements. In the case of welded wire mesh soil reinforcement, this is achieved by the development of passive resistance on the projected area of the mesh crossbars, which in turn transfers load into the longitudinal bars. In the case of strip reinforcements, load transfer from the backfill is mainly achieved by the frictional interaction of the soil particles with the reinforcing strip. A retained earth structure is a stable, unified gravity mass that can be designed for use in a wide range of civil engineering applications ranging for instance from retaining walls to highway bridge abutments.

FIG. 1 is a schematic cross-sectional side view illustrating the principle of retained earth as used in a retaining wall construction according to one example. As shown in that figure, the system requires only three main components to provide a stable structure: reinforcing elements 101, such as polymeric strips, a facing element 103 or a front wall 103 made of elements, such as precast facing panels or welded wire mesh, and backfill material 105.

Most of the current construction practices for retaining wall construction using retained earth or similar methods with flexible strip reinforcements delivered on a roll involve two distinct steps: a strip installation step and a strip tensioning step. For the strip installation step, generally, a temporary back anchorage is installed by laying longitudinal bars and hammering in vertical bars or pegs at regular spacing along the length of the wall at the end of the strip furthest from the facing element. To install the reinforcement strip, it is unrolled and attached to a series of front connections at the facing panels and around the back anchorages. In some cases the strip is inserted into the facing element and pulled out of the facing element to form the connection, requiring a long length of strip to be pulled thorough successive connections. For the tensioning step, the strip is then tensioned with various methods, sometimes ad hoc, but generally as per one of the following two methods:

- manual tensioning;
- tensioning with a tensioner system which consists of a gripper, a cable puller and a load gauge (see for example WO02/38872 A1).

The strip installation step is normally completed in bays for a length of the facing element 103 before the strip tensioning is done on the same bay. However, the current strip installation and tensioning methods have some drawbacks. Feeding the whole roll of strip through multiple connections is inefficient and time consuming. Also a lot of labour is involved to install the longitudinal and vertical anchorage bars and/or pegs as well to install and tension the strips. Moreover, installation of anchoring bars and strip tensioning are two separate activities which consume much time. The current anchorage arrangements also involve elements that are not specifically designed for anchorage purposes (e.g. the longitudinal rebar running parallel to the front facing panels); hence there is inefficient use of material. Furthermore, in the existing tensioning methods, the amount of tensioning force applied is not consistently applied or controlled and maintained, especially with the manual method. Uneven tensioning may result in uneven displacements of facing panels and hence, uneven wall alignment.

It is the object of the present invention to overcome the problems identified above related to the installation and tensioning of the reinforcement strips.

SUMMARY OF THE INVENTION

According to a first aspect of the invention, there is provided a method of installing and tensioning a reinforcement strip in a soil retained by a facing element together with the reinforcement strip extending between the facing element and an anchorage zone located away from the facing element and separated from the facing element, the method comprising:

- installing the reinforcement strip in the soil so that the strip extends from a first location in the anchorage zone through a connection point at the facing element to a second location in the anchorage zone, wherein a section of the strip from the first location to the connection point forms a first leg, while a section of the strip from the connection point to the second location forms a second leg;
- tensioning the strip by pulling the strip to a predetermined tension at the first location and at the second location so that the first leg and the second leg have substantially the same tension; and
- anchoring the strip at the first location and at the second location so that the strip is kept under tension when anchored.

The proposed method offers some clear advantages over the known solutions. By following the principles of the present method, a consistent tensioning force can be applied to the strips, thus increasing the overall quality of the wall installation works and the final alignment of the wall facing elements. Also, the required tensioning force can be adjusted for different projects, depending on the expected movement of the facing element after tensioning of the strip and during the soil installation at its back, on the expected movement of the anchorage pegs or pins and on the desired final tension force of the strips. Furthermore, with the method according to the present invention, a significant reduction in required labour, reduction in labour idling time and faster wall installation through a significant increase in overall productivity can be obtained. Moreover, the present invention also provides a reduction in material for the temporary back anchorages. Also, according to one embodiment, the proposed method provides an integrated strip installation and tensioning method from one end of the front wall to the other end of the wall.

According to a second aspect of the invention, there is provided a tensioning device for installing and tensioning a reinforcement strip in a soil retained by a facing element together with the reinforcement strip extending between the facing element and an anchorage zone located away from the facing element and separated from the facing element, the device comprising:

means for connecting the strip to the tensioning device at a first location in the anchorage zone of the soil, the strip extending from the first location to a connection point at the facing element, wherein a section of the strip from the first location to the connection point forms a first leg;

means for connecting the strip looped from the connection point at the facing element to the tensioning device in a second location in the anchorage zone, wherein a section of the strip from the connection point to the second location forms a second leg; and a strip tensioner for tensioning the strip by pulling the strip to a predetermined tension at the first location and at the second location so that the first leg and the second leg have substantially the same tension.

According to a third aspect of the invention, there is provided an assembly for use in retained earth solutions, the assembly comprising a peg arranged to be driven into soil, a wedge and a strip, the peg and the wedge being made of rigid material, wherein the wedge is arranged to be used in the assembly so that it prevents the strip from slipping with respect to the peg, when in place in a hole in the peg, the strip passing through the hole; or in a hole in an element surrounding the peg, the strip passing through the hole, and the peg passing through the element.

Other aspects of the invention are recited in the dependent claims attached hereto.

BRIEF DESCRIPTION OF THE DRAWINGS

Other features and advantages of the invention will become apparent from the following description of non-limiting exemplary embodiments, with reference to the appended drawings, in which.

DETAILED DESCRIPTION OF EMBODIMENTS OF THE INVENTION

Figure 1:
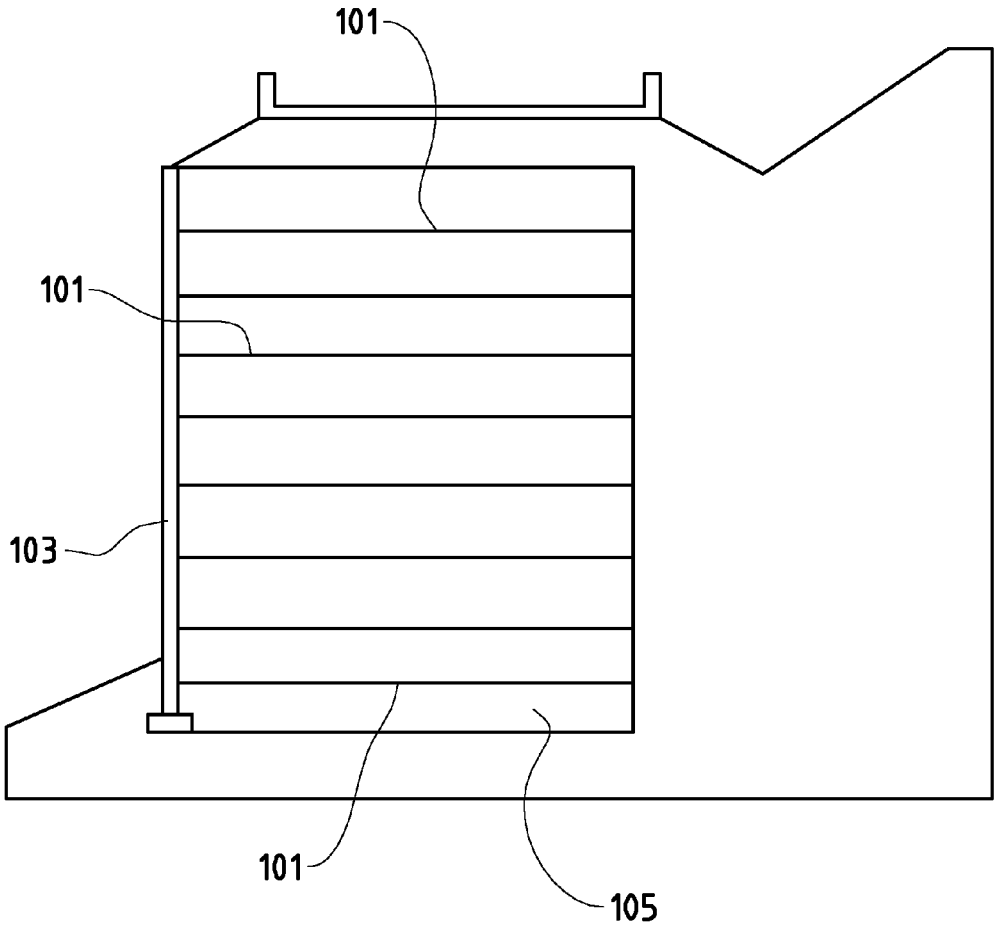
FIG. 1 is a schematic cross-sectional view of an earth retainment principle.

Some embodiments of the present invention will be described in the following in more detail with reference to the attached figures. Identical functional and structural elements which appear in the different drawings are assigned the same reference numerals.

Figure 2:
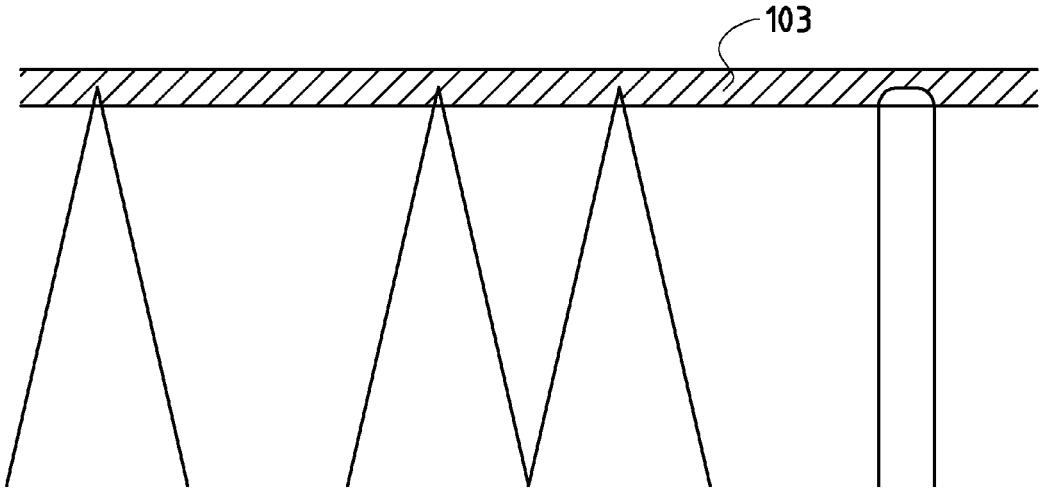
FIG. 2 is a schematic plan view illustrating different shapes of strips seen from above.
Figure 12:
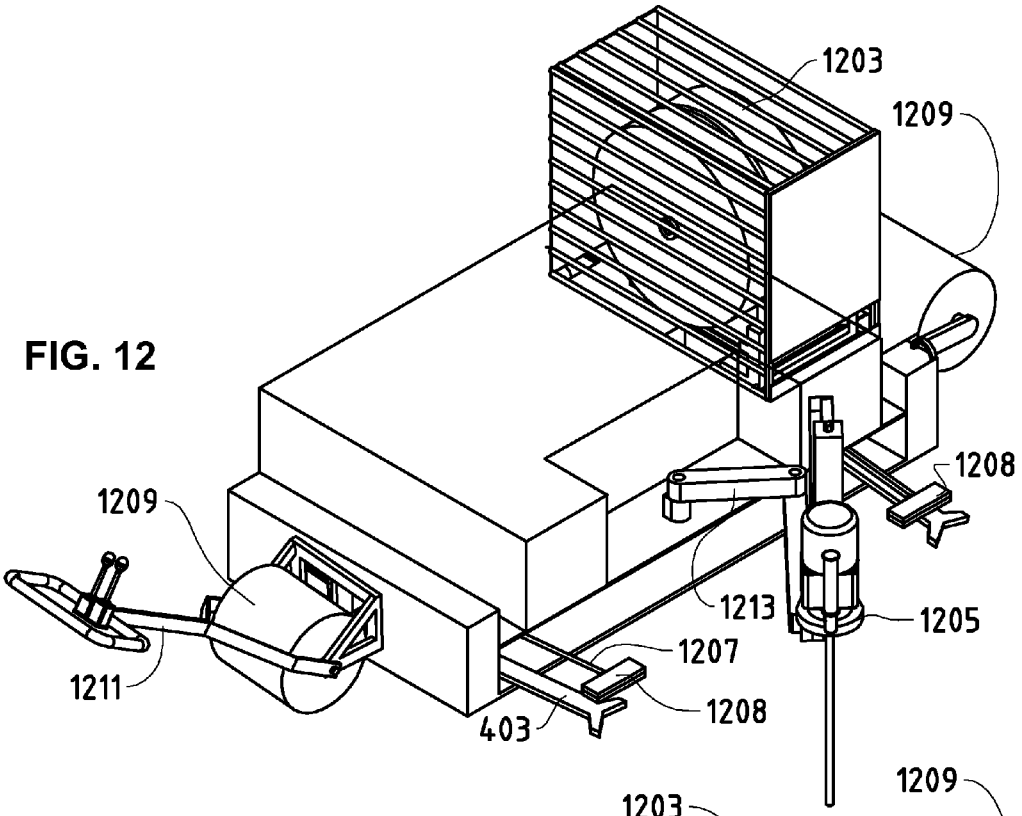
FIG. 12 is a perspective view of the tensioning device or machine according to the present invention.
Figure 13:
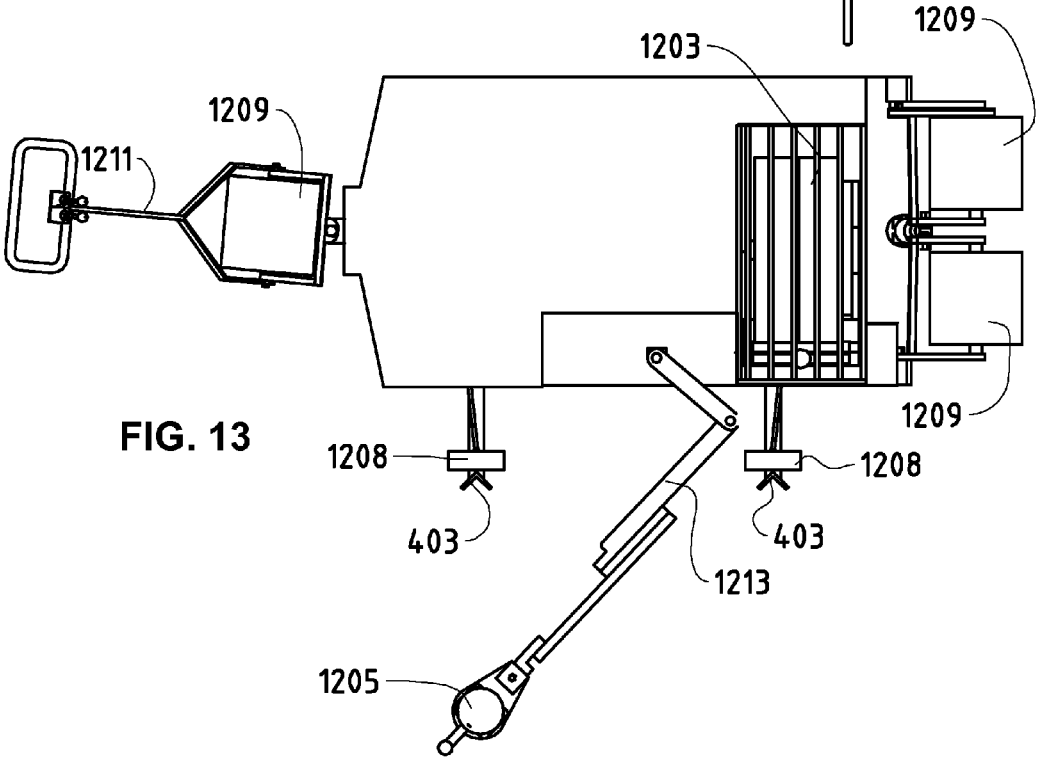
FIG. 13 is a plan view of a tensioning device according to the present invention.

The scheme according to the first exemplary embodiment of the present invention involves having the strip installation, tensioning and securing (anchoring) steps, prior to releasing the strip by a tensioning apparatus. All these steps can eventually be made in one operation by one machine as shown in FIGS. 12 and 13. In this scheme, it is proposed to cut the strips at the back of each strip in the anchorage zone and to anchor them independently from the next strip sequence (strip V series). However, it is to be noted that the principles presented next also apply to strips in the shape (when seen from above the fill) of a W or U, a double V or U, or a series of V or U as illustrated in FIG. 2.

Figure 3:
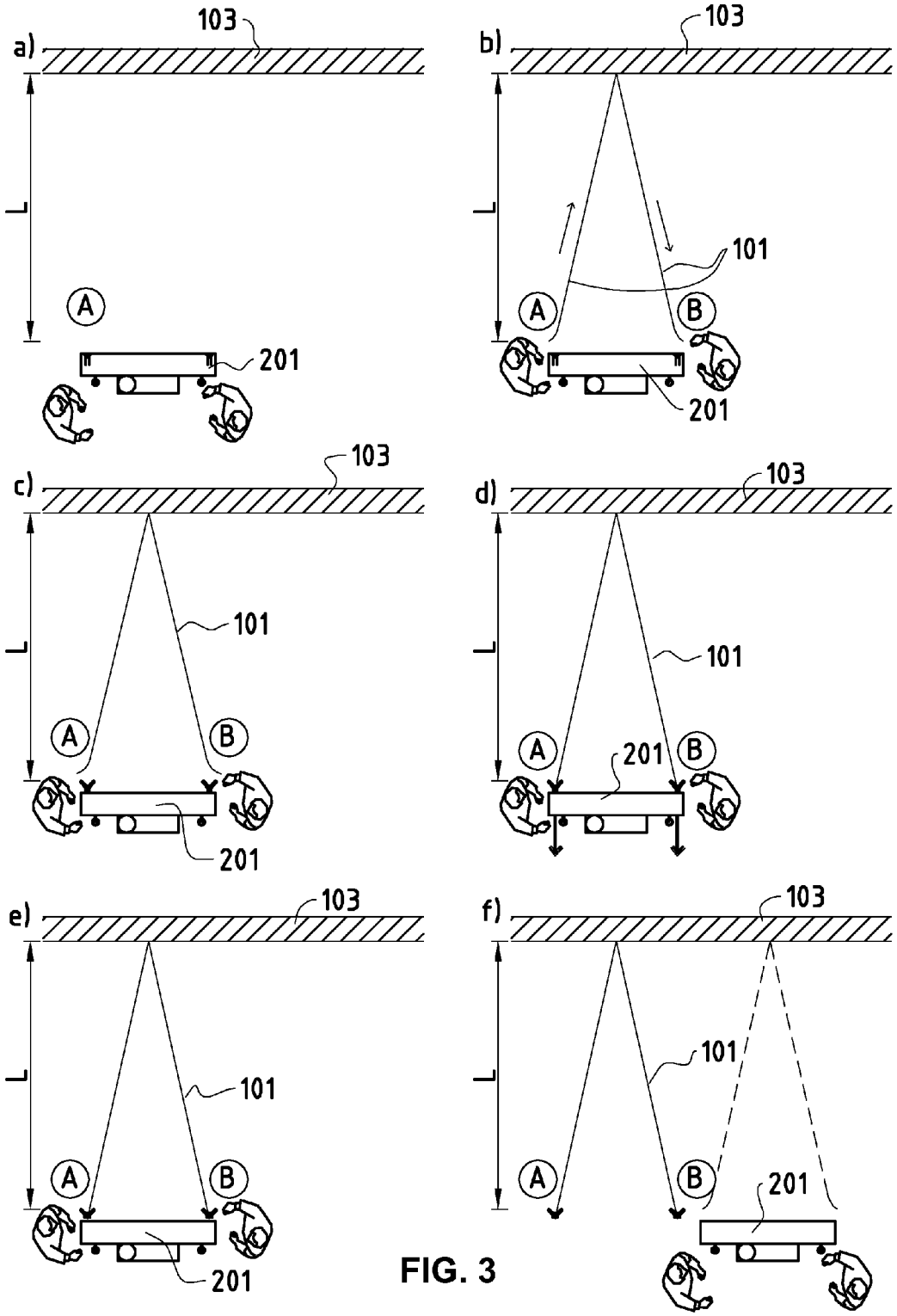
FIG. 3 is a schematic plan view illustrating different steps of the strip installation and tensioning process according to a first embodiment of the present invention.
Figure 4:
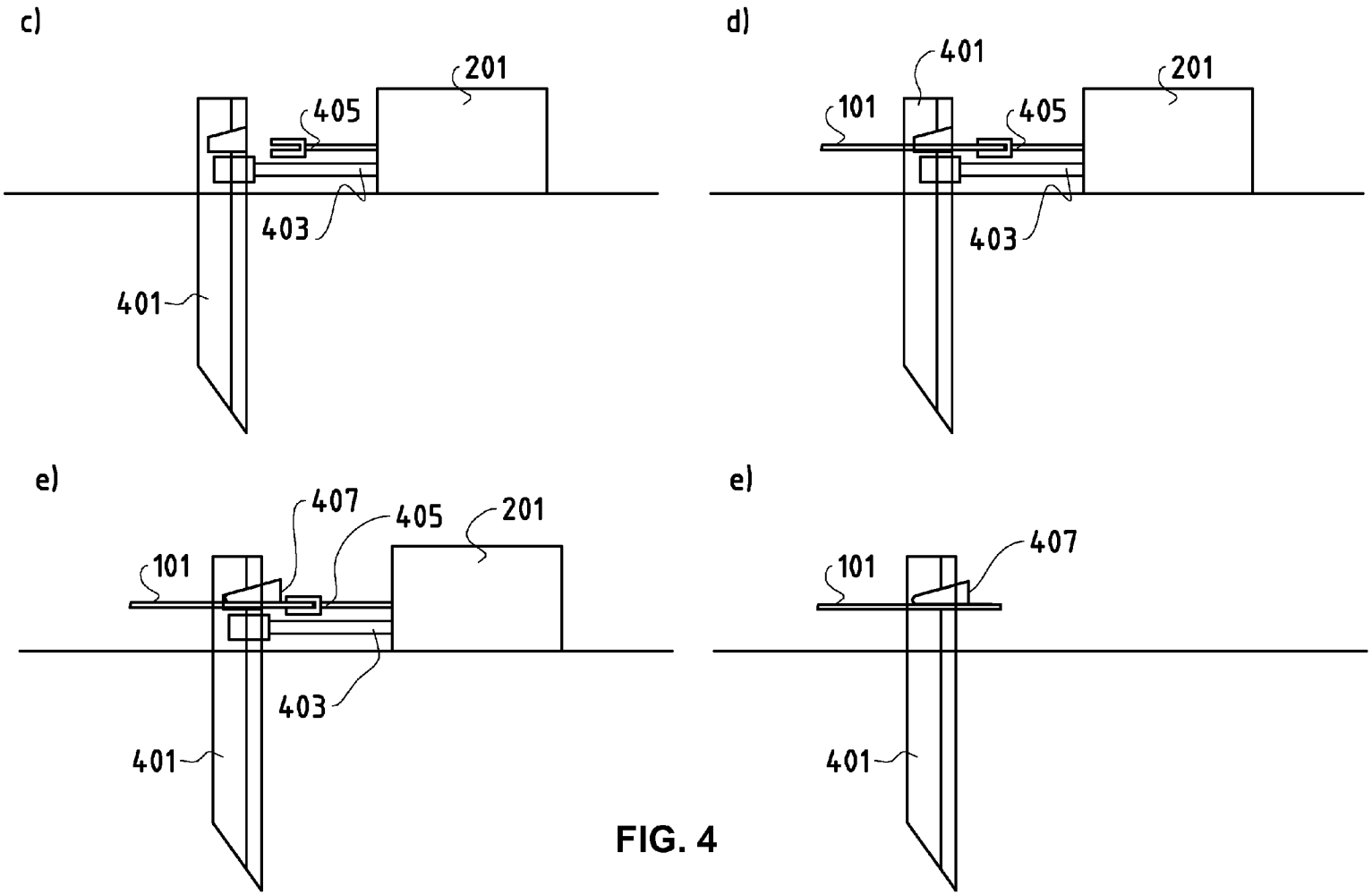
FIG. 4 is a schematic side view showing an anchoring assembly together with the tensioning device and illustrating some steps of the strip installation and tensioning process according to the first embodiment of the present invention.
Figure 5:
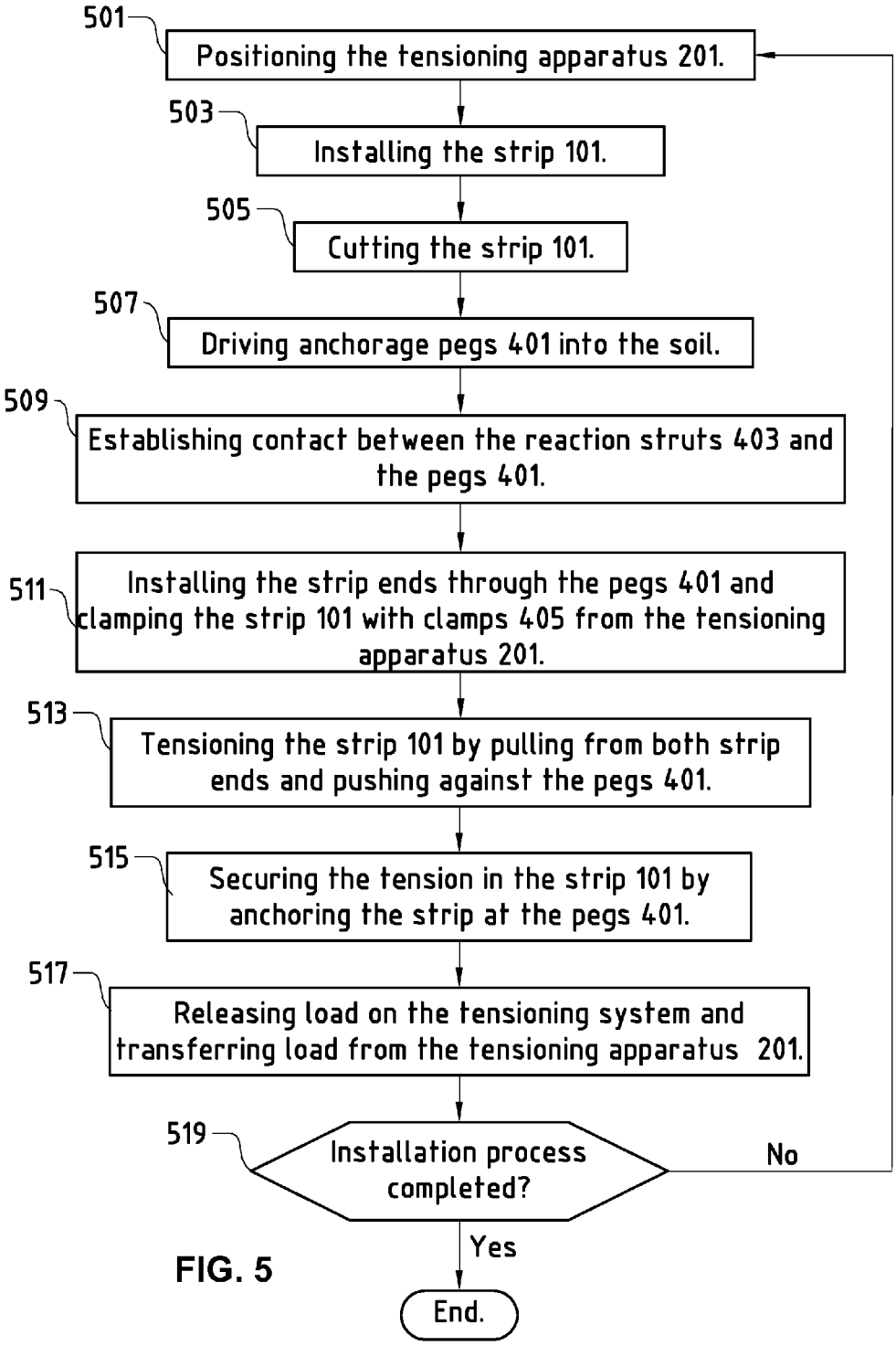
FIG. 5 is a flow chart illustrating the strip installation and tensioning method according to the first embodiment of the present invention.

With reference to FIGS. 3, 4 and to the flow chart of FIG. 5, the strip installation is performed in this example, in accordance with the first embodiment, as follows:

a) In step 501 the operator positions the tensioning device 201 at a required location on the compacted fill (backfill) and sets it in place.

b) In step 503 the operator installs the strip 101 by pulling out the strip 101 from a first position A, forming a first connection with the facing panel of the wall 103, returning the strip 101 to a second position B, and in step 505 cutting the strip 101 at the first location A. Step 503 could be repeated in another location before the cutting, should the tensioning device 201 be capable of tensioning W shape, double V shape or multiple V series.

c) In step 507 the tensioning device 201 drives anchoring pegs or rods 401 into the soil at locations A and B. In fact, the order of work for steps 503, 505 and 507 can be interchangeable.

d) In step 509, the operator extends reaction struts 403 from the tensioning device 201 to be in contact with the already driven pegs 401. The reaction struts 403 are attached to the tensioning device 201, and are movable to compensate for possible differences in the distance between two or more driven pegs. In step 511 the operator feeds the free ends of the strip 101 through the holes in the driven-in pegs 401 and further attaches the free ends of the strip 101 with the clamping means 405 that are movable and extend from the tensioning device 201. The operator then activates the tensioning system of the tensioning device 201 in step 513 by pulling the strip ends at locations A and B (the arrows indicating the direction where the strip ends are pulled). However, it is to be noted that the pulling at locations A and B does not have to be simultaneous. For instance, while pulling at a first location, the strip at a second location can be held in place. During the whole tensioning process, the reaction strut 403 remains in contact with the peg 401, and exerts a force that pushes the peg 401 towards the wall 103. This force in the reaction strut 403 can be actively or passively applied by the tensioning device 201, and it shall be equal to or greater than the tensioning force experienced by strip 101. At the end of this operation, tensioning of the strip 101 and preloading of the peg 401 against the soil are achieved.

e) In step 515 a wedge piece 407 is pushed into the gap between the strip 101 and the peg 401. In step 517, the tensioning device 201 then releases load on the tensioning system, and transfers load to the pegs 401. A small loss in the tension force in the strip 101 is anticipated during this load transfer, and shall be taken into account to determine the final locked-in tension force in the strip. For other anchorage systems that do not have wedge component, as for the example shown in FIG. 6*g*, the details of load transfer mechanism may differ from what is described here.

f) If in step 519 it is determined that another series of strips 101 should be installed, then the tensioning device 201 is repositioned at a next location, and the process is repeated.

When the strip 101 is pulled, the force T on the strip 101 is controlled and measured. During tensioning of the strip, if the desired preloading force on the peg 401 is T, it is easiest achieved by connecting the clamping element 405 directly to the reaction strut 403 without transferring any force to the overall tensioning device 201. This is defined as the passive tensioning mentioned above. However, if preloading force on peg 401 is desired to be bigger than T, this can be achieved by tensioning the strip to force T and at the same time actively applying through the reaction strut 403 a force R which is bigger than T. The tensioning device 201 would then have to take the difference F=R-T through friction with the soil. Preloading to a higher force might be required for soils that exhibit large plastic deformations. Of course, after load transfer, the force in the peg is the same as the force in the strip, regardless of active or passive tensioning.

In the above process, the first and second locations are in a zone of fill called the anchorage zone, which is situated at a distance L (this distance does not have to be constant) from the front wall 103. The series of pegs 401 or anchorages may or may not be parallel to the front wall 103. As explained, the strip installation, cutting, tensioning and peg anchoring can all be done and completed for one connection of the strip before moving on to the next series of strips 101.

Figure 6A:
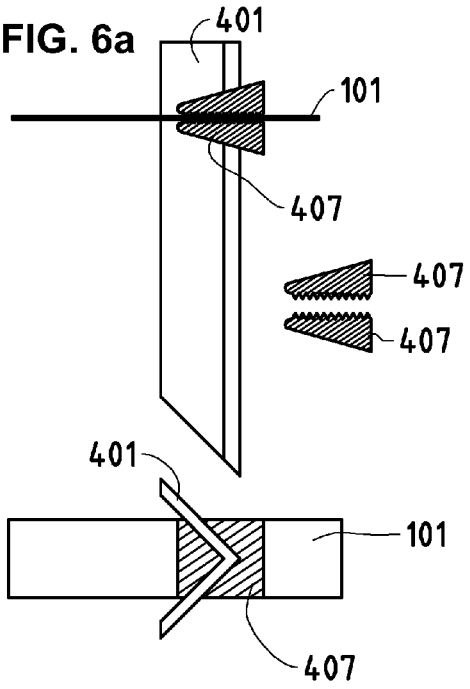
FIGS. 6*a* to 6*g* illustrate in side, top and perspective views some examples of the anchoring assemblies used in the process according to the first embodiment of the present invention.
Figure 6B:
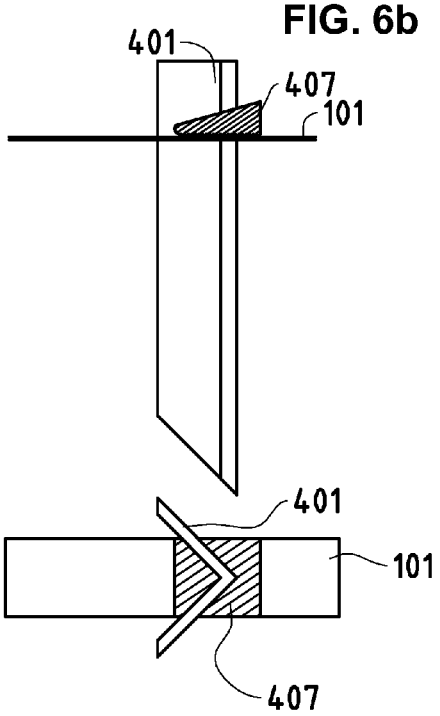

FIGS. 6*a*, 6*b*, 6*c*, 6*d*, 6*e*, 6*f* and 6*g* illustrate in side, top and perspective views different options for anchoring pegs 401 to be used in the first embodiment. FIGS. 6*a* and 6*b* show solutions where the strip 101 can be fed through the peg 401, and then the strip 101 can be secured in place by inserting a wedge 407 between the strip 101 and the peg 401. In the solution of FIG. 6*a*, two wedges are used, and in this example, the surfaces of the wedges 407 that are in contact with the strip 101 are rough or have teeth to increase friction. Of course the wedge shown in FIG. 6*b* could also have a rough surface, preferably the surface that is in contact with the strip 101.

Figure 6C:
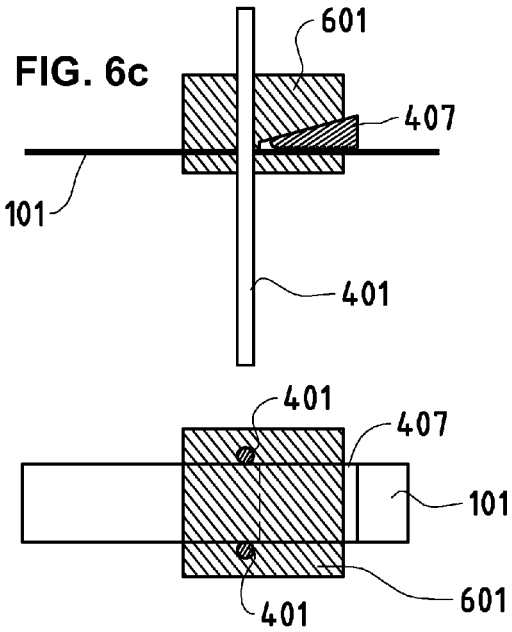
Figure 6D:
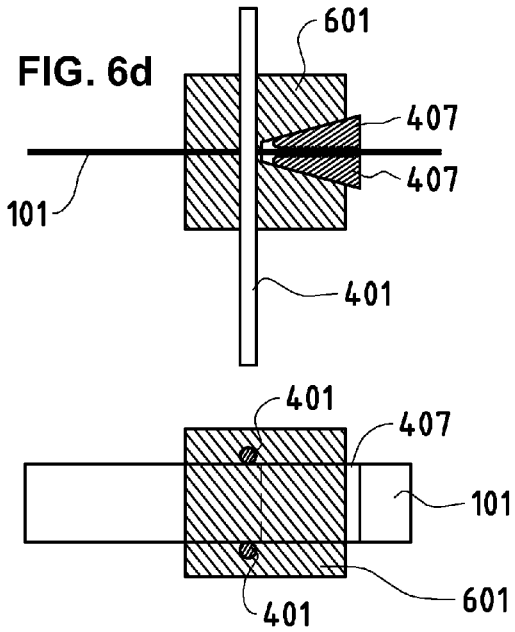

FIG. 6*c* shows an example, where the anchoring peg 401 comprises two reinforcing bars, which are connected by a box 601, in this example a plastic box. The strip is arranged to be fed through the box 601, and again a wedge 407 or wedges 407 can be used to secure the strip 101 in place when under tension. The width of the wedge 407 could of course be different from the one shown in this figure. The configuration of FIG. 6*d* differs from the configuration of FIG. 6*c* in that in the solution of FIG. 6*d* two wedges 407 are used: one on top of the strip 101, and the other under the strip 101.

Figure 6E:
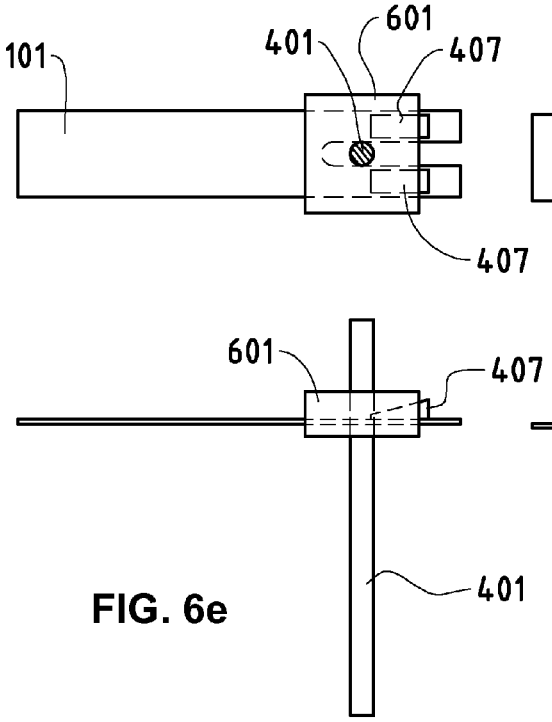
Figure 6F:
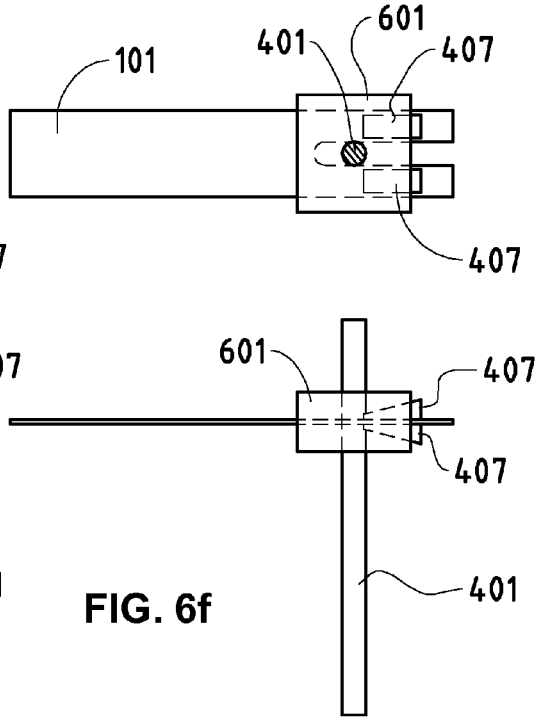

FIG. 6*e* shows a similar variation where instead of two reinforcing bars, one bar is used and the strip 101 is cut in the middle to create a slot that allows the strip to be inserted through the anchorage with bar in the middle. In this example, two wedges 407 are used to secure the strip in place. The solution of FIG. 6*f* is very similar to the solution of FIG. 6*e*, the only difference being that in the solution of FIG. 6*f* four wedges are used.

Figure 6G:
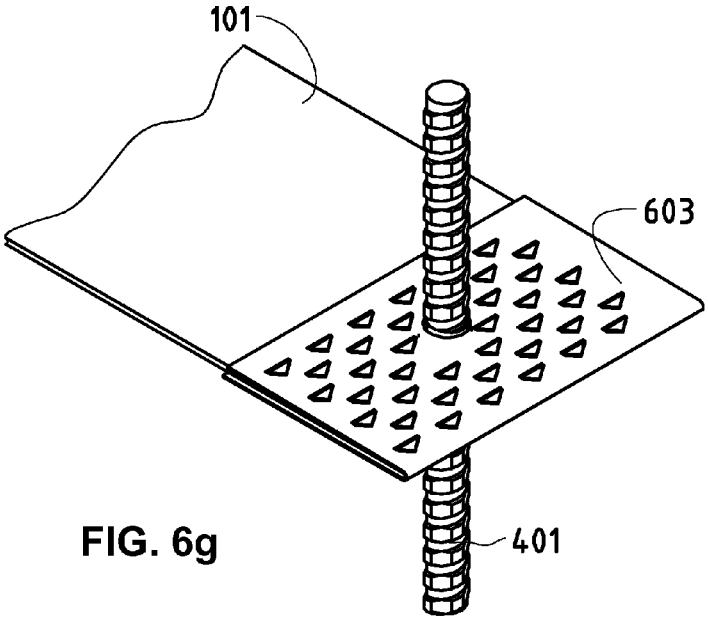

FIG. 6*g* shows another alternative, where instead of using a wedge, the strip 101 is sandwiched between plates 603 that bite into the strip 101 and grip it. The strip and the plates 603 have holes that are punched after the strip has been tensioned to allow the reinforcing bar 401 to go through. The plates 603 then anchor against the reinforcing bar 401. In the solutions of FIGS. 6*a* to 6*g*, the strip 101 is substantially perpendicular to the peg 401.

The first embodiment of the present invention has been described above. In the first embodiment, during tensioning the strips 101 are tensioned to substantially equal forces against anchor point, which in the first embodiment is the anchoring peg 401.

Next the second embodiment is explained in more detail. In the second embodiment, during tensioning the anchor point is the tensioning device 201. In accordance with the second embodiment, anchorage plates 901 or gripping devices (some examples shown in FIGS. 9*a* to 9*c*) can be attached at the end of the strips to allow the strips to be gripped and tensioned to a required force and anchored to the soil using pegs or pins as explained in the following in more detail.

Figure 7:
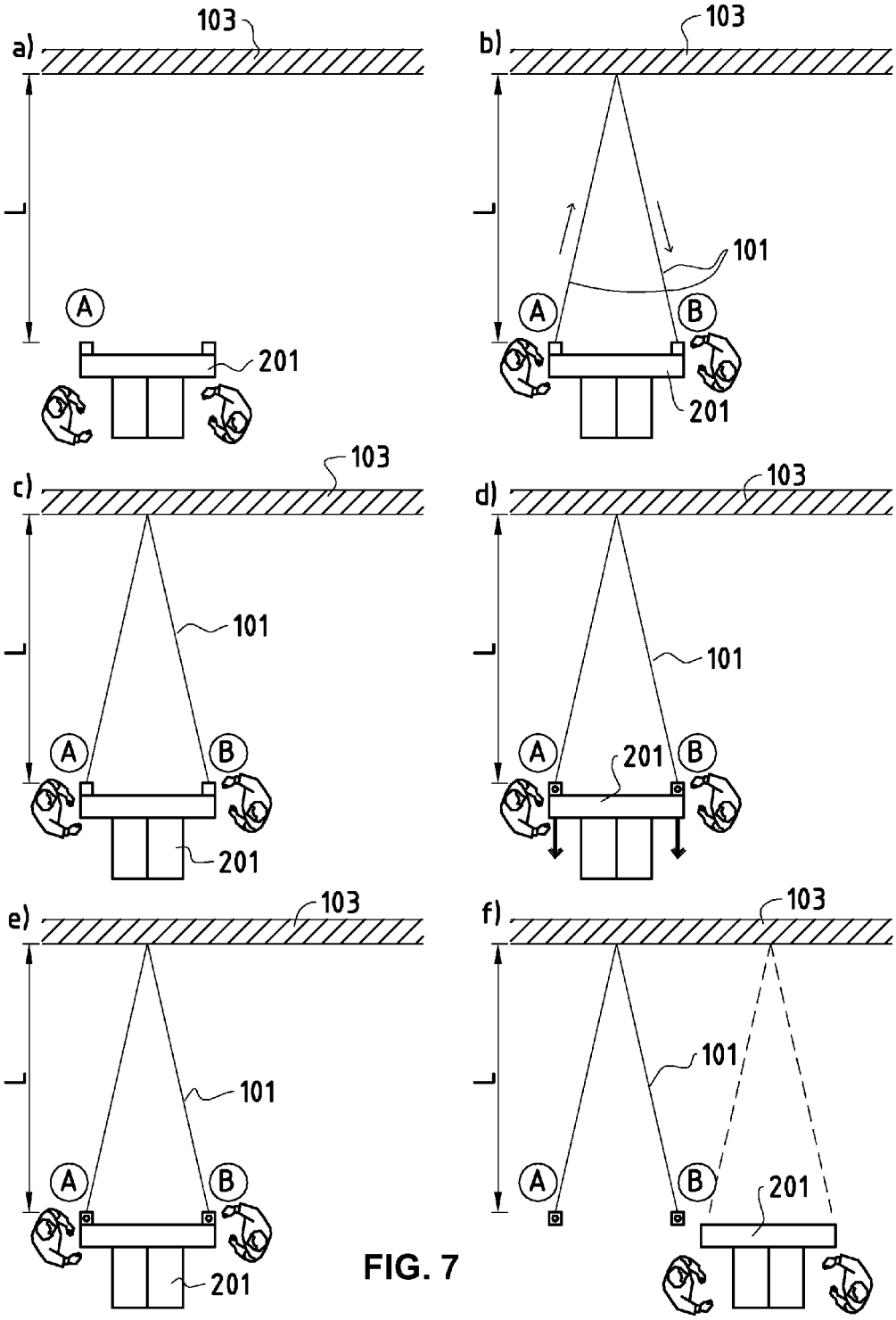
FIG. 7 is a schematic plan view illustrating different steps of the strip installation and tensioning process according to a second embodiment of the present invention.
Figure 8:
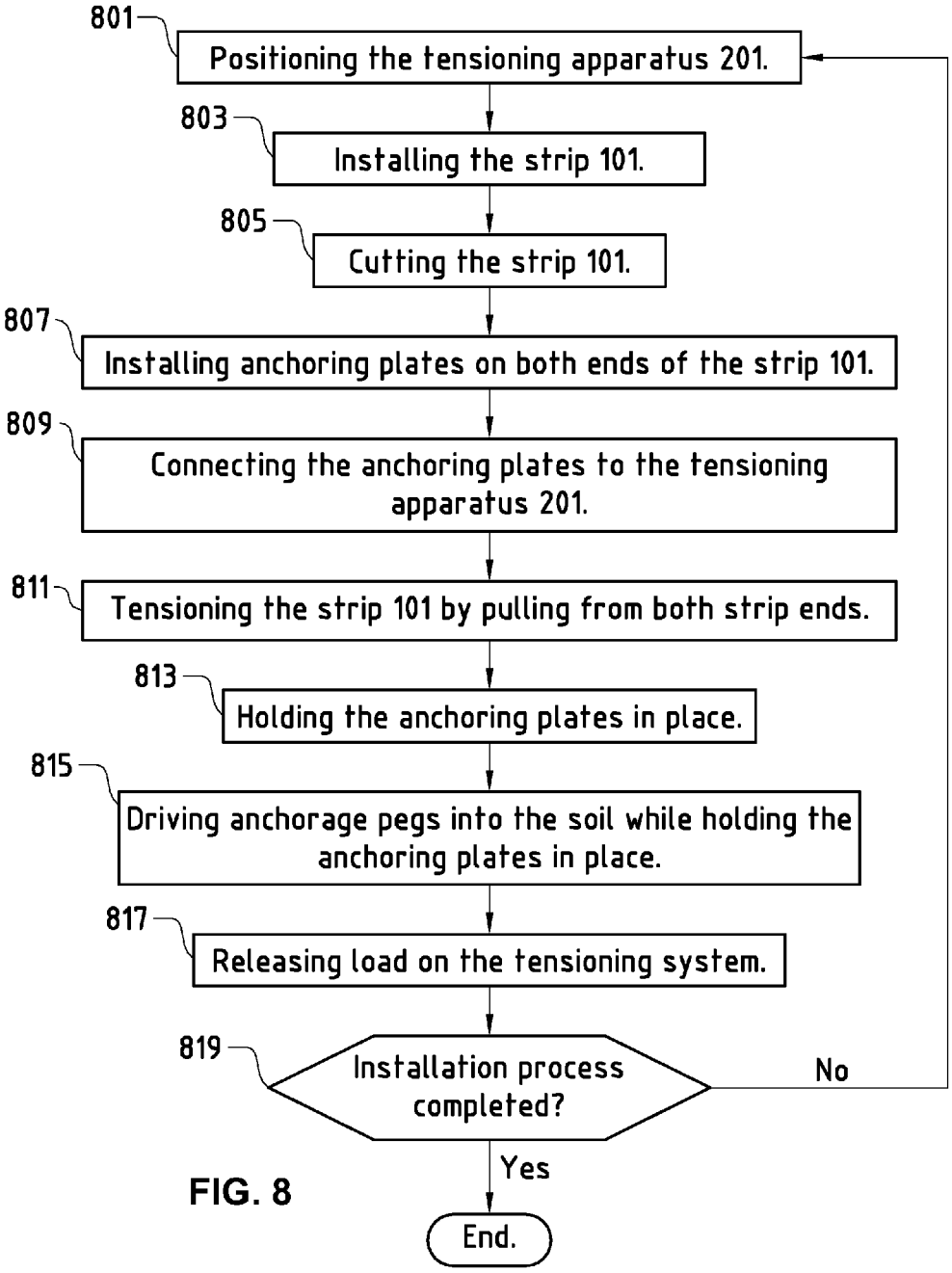
FIG. 8 is a flow chart illustrating the strip installation and tensioning method according to the second embodiment of the present invention.

With reference to FIG. 7 and to the flow chart of FIG. 8, the strip installation is performed in this example according to the following procedure:

a) In step 801 the operator positions the tensioning device 201 at a required location on the compacted fill (backfill) and sets it in place, by for instance lowering it on the base plate. If a compactor is used as a tensioning device 201, then there is no need to lower it or to secure it. Its weight would be enough to keep it in place.

b) In step 803 the operator installs the strip 101 by pulling out the strip 101 from a first position A, forming a first connection with the facing panel of the wall 103, returning the strip 101 to a second position B, and in step 805 cutting the strip 101 at the first location A. Step 803 could be repeated in another location before the cutting, should the tensioning device 201 be capable of stressing W shape, double V shape or multiple V series. In fact, steps 803 and 805 could be interchangeable.

c) In step 807 the operator installs anchoring buckles or plates 901 or other gripping systems on both ends of the strip 101 at locations A and B, and in step 809 connects the plates 901 to Before the plates 901 are connected to the tensioning device, any slack in the strip 101 is preferably eliminated. However, the slack removal could be also done later, e.g. after the anchoring plates 901 have been connected to the tensioning device 201.

d) In step 811 the operator activates the tensioning system of the tensioning device 201 for tensioning the strip 101 by pulling the strip ends at locations A and B (the arrows indicating the direction where the strip ends are pulled). It is to be noted that the pulling at locations A and B does not have to be simultaneous, although it can be simultaneous. For instance, while pulling at a first location, the strip at a second location can be held in place. The device 201 holds the anchoring plates 901 in place in step 813, and in step 815 the device 201 drives anchoring pegs 401 into the soil at locations A and B while holding the anchoring plates 901 in place.

e) In step 817 the device 201 releases load on the tensioning system and transfers load to the pegs.

f) If in step 819 it is determined that another series of strips 101 should be installed, then the tensioning device 201 is repositioned at a next location, and the process is repeated.

Figure 9A:
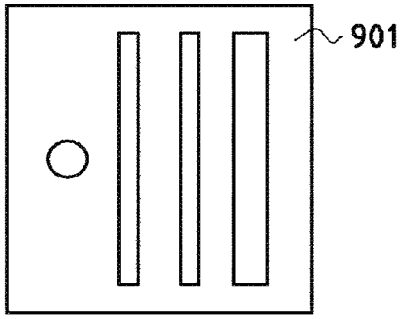
FIGS. 9*a* to 9*c* are plan views showing examples of an anchoring element for anchoring the strip according to the second embodiment of the present invention.
Figure 9B:
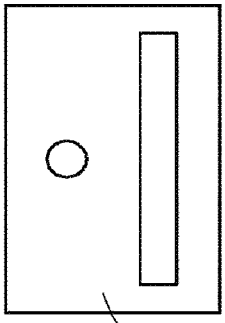
Figure 9C:
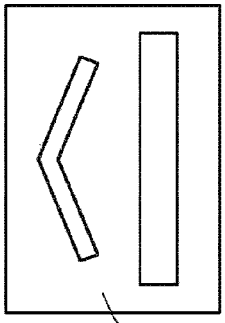
Figure 10:
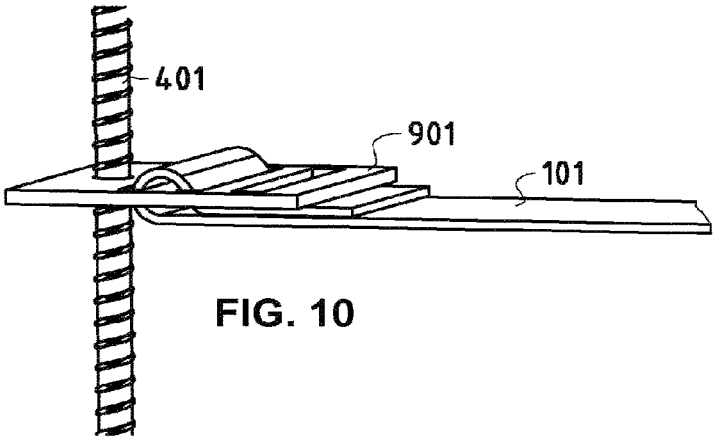
FIG. 10 is a perspective view showing how the strip can be connected to one anchoring element.

FIGS. 9*a*, 9*b* and 9*c* show in a plan view three different examples of anchoring plates 901. The plate 901 is typically made of metal or a polymer material. In the solution of FIG. 9*a*, the plate 901 has three longitudinal holes or openings and one circular hole or opening for the peg to pass through it. The cross-sectional thickness of the plate 901 is, for example, 3-5 mm. The size of the hole in the plate is only slightly bigger than the diameter of the peg. FIG. 10 illustrates how the strip 101 can be connected to the plate 901 of FIG. 9*a*. In that figure one of the longitudinal holes is not used, but by looping the strip 101 also through this hole a higher tensioning force can be applied without the strip 101 slipping with respect to the plate. As can be seen, the strip 101 is looped through the widest longitudinal hole and at least one of the narrower longitudinal holes. In FIG. 10 there is also shown the peg 401.

Figure 11:
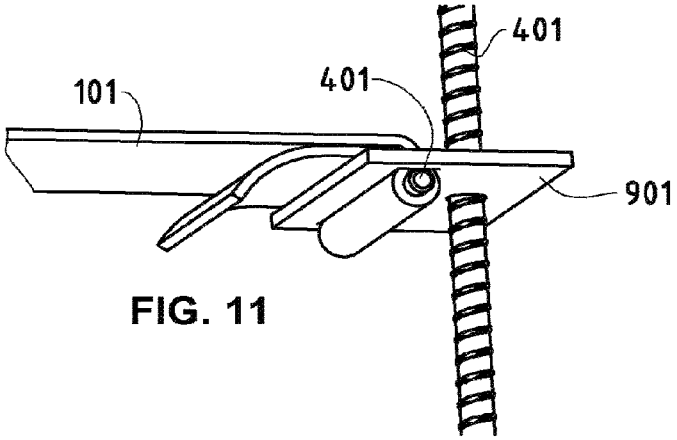
FIG. 11 is a perspective view showing how the strip can be connected to another anchoring element.

The solution of FIG. 9*b* shows another example of the plate 901. In this example the plate 901 has only one longitudinal hole and one circular hole for the peg 401. In this example the strip 101 is fed through the single longitudinal hole from a first side of the plate 901, and then a short piece of rod 401, in this example a rebar with a diameter of for instance 10-15 mm (the diameter of the longitudinal hole can be the same), is inserted through the loop formed by the strip 101 on a second side of the plate 901, as illustrated in FIG. 11. Then the strip 101 is looped back to the first side of the plate 901. Thanks to the rod 401 in the loop, the strip 101 cannot slip through the hole when tensioned by pulling from the plate 901. FIG. 9*c* shows an arrangement that is similar to the plate shown in FIG. 9*b*, but in the arrangement of FIG. 9*c*, a peg 401 having a V cross-section is arranged to be pushed through the hole in the plate 901. The back anchorage solution with the plate of the type in FIG. 9*b* or 9*c* is an especially advantageous solution because it is easy and inexpensive to manufacture, easy to install, and it resists significant force from the strip. In some applications the anchorage plate 901 and the peg 401 could be one single element.

Both the anchorage plates 901 and the pegs 401 are made of a solid material, such as metal or a polymeric material. The pegs could also be purpose made from metal or plastic to such a design as to provide optimum resistance to the applied forces during service. The cross section of anchorage pegs can have a V shape or be circular (can for example simply be rebar pieces), the length of which depends on the properties of the soil, the length being usually in the range of 300 mm to 800 mm. As far as the anchorage plates 901 are concerned, the shape of the hole for the peg does not have to be circular, but it advantageously has a shape similar to the cross section of the peg 401.

In all the anchorage plates 901, additional holes can be punched in the plate 901 to allow for connection to the tensioning device 201 while the peg 401 is driven through the hole designed for the peg 401. Alternatively or additionally, the plates 901 can have a specific geometry that allows them to be connected to the tensioning device 201.

According to the embodiments of the present invention, the pegs 401 could be driven into the soil, for instance with the following methods: pre-drill, hammering, pre-drilling plus hammering or by pressure and vibration. The pegs could be inserted into the ground vertically or with an inclination in order to find the most efficient anchoring.

It should be noted that according to the present invention the tensioning force applied to the reinforcing strips 101 should not be too great. Otherwise there is a risk that the installed panels of the wall 103 are moved by pulling them out of alignment with the strip. It should also be considered that additional tensioning of the strip 101 also happens during the process of subsequent panel installation and soil compacting. Normally, the panel is initially slightly inclined towards the soil when it is placed into the wall 103, and during soil compaction the panel will be pushed or rotated out, to the vertical or near vertical position. During this process, the strip 101 is additionally tensioned, and hence to ensure that the total required tension is applied to the strip, this additional tension contribution should be considered as well, when determining the tension to be provided by the tensioning device 201. Generally, the applied strip tension will be less than 5% of the ultimate tensile strength of the reinforcing strip.

When the strip 101 is tensioned, the strip 101 will apply a predominantly horizontal force to the peg, which will be subjected to some movement in the direction of loading under the action of this force, which will result in some loss of tension in the strip 101. This can be the case with the above-described second embodiment. The loss of strip tension or draw-in effect due to movement of the pegged bar in the soil after tensioning and load transfer should also be considered, and can be also taken into account by slightly over-tensioning, i.e. tensioning a bit more than needed. The actual loss of tensioning force due to draw-in depends on: the length of the strip, the capacity of the strip, the stiffness of the strip. The loss of the tensioning force can be calculated based on observed draw-in distance with a specific type of soil. The advantage of the first embodiment is that there is no need to consider the draw-in effect, and the tensioned force in the strip 101 is exactly known.

Described next is an example of the tensioning device 201, shown in a front, perspective view in FIG. 12 and in a plan view in FIG. 13. In this example the tensioning device 201 is a mechanised device arranged to assist with the installation and tensioning (pre-loading) of the reinforcement strips 101. The device 201 is designed to allow site installation of the reinforcement strips 101 to be performed by one to two persons only. This is a significant productivity gain compared with the currently applied manual installation and pre-loading process.

The device 201 allows modifying the installation and tensioning process of the strip 101. This provides cost savings as well as quality improvements as explained below:

- The continuous placing of the strip into multiple wall connections can be replaced by installation of the strips 101 to be in the form of a V (or in another form, such as a "W" shape, as mentioned above) in the fill. The base of the V is looped at the wall 103 while both ends of the "arms" or "legs" of the V-shape are anchored to the soil.
- Both ends of the strip 101 in the form of a V (for example) can be anchored individually in the soil using the pegs 401 and corresponding anchoring elements depending on the embodiments.
- Pre-loading or tensioning can be achieved by tensioning both ends of the strip 101 by pulling them with substantially equal force, thereby ensuring a controlled and uniform tensioning. Tensioning can be applied by a single tensioning device attached to both ends of a V-shaped (for example) strip and individual tensioning devices where each device is attached to one end of the strip to tension it (simultaneously or not), or by one individual tensioning device which tensions one end of the strip at a time and is then moved to the next strip end.

The device 201 could be fully autonomous, self-powered and hydraulically, mechanically or electrically driven. At its most basic form, the device 201 consists of a single or plurality of tensioning systems with its corresponding power generator and force measurement device. The tensioning device has a tensioning system 1207 which may consist of hydraulically driven single ram with a pulling rope system or a series of independent jacks or winches. The spacing of the pulling ropes or cables can be adjusted. This guarantees that the spacing of the strip ends when connected to the device 201 can be adjusted. It also has gripping means 1208 for gripping the strip or for gripping the plates 901. The device can also be equipped with peg pushing means 403, such as the strut 403 to push the peg 401 in accordance with the first embodiment.

If the tensioning is done according to the first embodiment, then the tensioning device 201 can be light. This is possible, since the reaction point for the tensioning device is the anchoring peg 401. However, if the tensioning device is done according to the second embodiment, it needs to act with its ballast as a reaction point for the tensioning operation. According to the second embodiment, in order to anchor the device 201 during a tensioning operation, generally the device will use its self weight and friction with the soil to resist the tension force from the strip. If it is required to increase the weight of the device, it is possible to attach a large ballasting cylinder, located next to the device 201 and with an adequate weight to secure the machine to the ground while stressing the strip. The cylinder can be like the drum of a road roller. It can be filled with water or soil that is available on site up to the required weight. Furthermore, the base plate underneath the device 201 can be equipped with soil studs for improved friction resistance.

The device 201 can be placed outside of the reinforced soil block during tensioning, as illustrated in FIG. 3 or 7, as well as within the reinforced soil block, for the cases where the working space behind the reinforced block is limited. In other words, the tensioning device 201 can also be located between the anchored pegs and the wall 103. In this case the device 201 would exert on the peg 401 a pulling force instead of exerting on the peg 401 a pushing force as in the case where the device is located outside of the reinforced soil block, as illustrated in FIGS. 3 and 7. In all situations a force essentially towards the front wall 103 is exerted on the pegs 401. However, while tensioning the strip 101, the direction of the force exerted on the strip 101 does not necessary have to be away from the front wall 103, although in practice this is often the direction of the force exerted on the strip 101.

The device 201 also incorporates additional features in its more complete form, as described here and shown in FIGS. 12 and 13. The device is preferably fitted with all elements required for the installation and tensioning of the strips 101, namely strip dispenser, uncoiler or feeder 1203 (which can be operated manually) and hydraulic strip cutter. In the present method, cutting of the strip can be done efficiently and quickly, for instance with a blade knife, shears, a cutting wheel or an industrial cutter.

The device may also have an outrigger arm 1213 with the drill rig 1205 or mechanised peg driver 1205. In this example the outrigger arm 1213 has multiple hinges. The device 201 may further have alignment equipment (e.g. laser) to align with the front wall 103 to keep the device 201 at a certain distance (typically constant, but it does not have to be constant) from the wall 103.

The device 201 can provide storage compartments for all necessary components needed for the operation, i.e. the strips 101, pegs 401 and anchorage plates 901.

In this example the device 201 is a petrol-powered autonomous system with onboard generator and a hydraulic power pack. It has a hydraulic rear axle drive and a steerable front axle. The front and rear axles can be retractable, and thus they can be hydraulically raised and lowered. The device 201 further has wide, profiled rollers 1209 to ensure traction on bad ground and in wet conditions. The device is also equipped with a long enough steering arm 1211 that has all drive and steering controls. All the other operator controls are on the main body in a safe position. The device body can be disconnected and rotated by about 180 degrees, if required, to allow for opposite strip laying direction.

Different elements of the device can be easily mounted and demounted. Crane lifting points can also be provided on the device to allow lifting of the fully ballasted device 201. For ease of transportation, the device can be designed to fit onto two standard EUR pallets (1.2 m×0.8 m each). Moreover, all movable parts (e.g. the strip uncoiler 1203 and the strip cutter) can be designed in a way to avoid operator injuries. Of course, depending on the implementation details, not all the described elements are necessarily needed.

Figure 14:
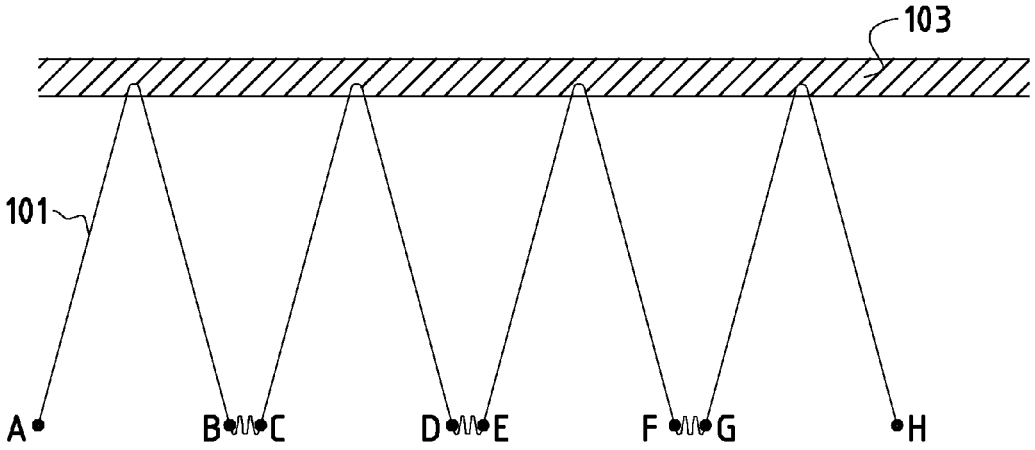
FIG. 14 is a schematic plan view illustrating how the strip can be installed in a fill according to a variant of the present invention.

According to a variant of the present invention, the strip 101 is not cut between tensioning operations. This variant can be used in connection with either the first or second embodiment. Thus, in this variant, the strip 101 is continuous from one end of the wall 103 to the other end of the wall 103, or from one end of a wall bay to the other end of the wall bay that is installed. This is shown in FIG. 14, where the strip anchorage points are indicated by references A to H. As can be seen, the strip 101 is continuous from the first anchorage point A to the last anchorage point H. In the anchorage zone where the strip is looped back towards the wall 101, between two consecutive anchorage points, e.g. between points B and C, the strip 101 has a slack part, where the strip is not under tension. Once a desired length of the strip 101 is placed in the fill, the strip is cut at location A, i.e. at the first anchorage point. However, it is to be noted that in this variant, it is also possible to cut the strip 101 once or more somewhere between the end anchorage points (in this case locations A and H), if need be.

In this variant, any one of the shown anchorages in FIGS. 6*a* to 6*g* and FIGS. 9*b* to 9*c* can be used. Furthermore, in this variant, the tensioning device 201 as described above can be used.

Two embodiments of the present invention were described above. The present invention makes it possible to obtain substantially uniform and specified tension in all strip sections between the anchorage points and the wall 103. Thus, all the strip sections can have a uniform tension within specified tolerance throughout the whole length of the wall 103.

While the invention has been illustrated and described in detail in the drawings and foregoing description, such illustration and description are to be considered illustrative or exemplary and not restrictive, the invention being not limited to the disclosed embodiments. Other embodiments and variants are understood, and can be achieved by those skilled in the art when carrying out the claimed invention, based on a study of the drawings, the disclosure and the appended claims.

In the claims, the word "comprising" does not exclude other elements or steps, and the indefinite article "a" or "an" does not exclude a plurality. In the claims by the word "anchoring element" is understood any element(s) used to anchor the strip 101 to the soil. Thus, depending on the specific application, the anchoring element can for instance be simply the anchoring peg 401 or the anchorage plate 901 or the combination of these or further elements. The mere fact that different features are recited in mutually different dependent claims does not indicate that a combination of these features cannot be advantageously used. Any reference signs in the claims should not be construed as limiting the scope of the invention.

The invention claimed is:

1. A method of installing and tensioning a reinforcement strip in a soil retained by a facing element together with the reinforcement strip extending between the facing element and an anchorage zone located away from the facing element and separated from the facing element, the method comprising: installing the reinforcement strip in the soil so that the reinforcement strip extends from a first location in the anchorage zone through a connection point at the facing element to a second location in the anchorage zone, wherein a section of the reinforcement strip from the first location to the connection point forms a first leg, while a section of the reinforcement strip from the connection point to the second location forms a second leg; tensioning the reinforcement strip by pulling the reinforcement strip to a predetermined tension at the first location and at the second location so that the first leg and the second leg have substantially the same tension; and anchoring the reinforcement strip to the soil at the first location and at the second location so that the reinforcement strip is kept under tension when anchored, wherein each leg is anchored individually by an anchoring element in the anchorage zone.

2. The method according to claim 1, the method further comprising using at the first location and the second location a first anchoring element and a second anchoring element, respectively, for anchoring the strip to the soil, wherein the first anchoring element and the second anchoring element comprise a first peg and a second peg, respectively, to be driven into the soil, and wherein the strip is fixed to the first and second anchoring elements when under tension.

3. The method according to claim 2, the method further comprising driving the first and second pegs into the soil before tensioning the strip, connecting the strip to the first and second anchoring elements, and fixing the tensioned strip to the first and second anchoring elements so that the strip is prevented from slipping with respect to the first and second anchoring elements.

4. The method according to claim 2, wherein the strip is tensioned by exerting a force on the strip at the first location for tensioning the strip, while at the same time exerting a force on the first peg towards the facing element and while holding the strip in place at the second location and after that also exerting a force on the strip at the second location for tensioning the strip, while at the same time exerting a force on the second peg towards the facing element or exerting a force on the strip simultaneously at the first location and at the second location for tensioning the strip, while at the same time exerting a force on the first peg and the second peg towards the facing element.

5. The method according to claim 2, the method further comprising driving the first peg and the second peg into the soil after tensioning the strip.

6. The method according to claim 5, wherein the first anchoring element further comprises a first anchoring plate and the second anchoring element further comprises a second anchoring plate, the method further comprising connecting the strip to the first anchoring plate and to the second anchoring plate so that the strip is prevented from slipping with respect to the first and second anchoring plates, pulling the strip from the first and second anchoring plates, and inserting the first peg through an opening in the first anchoring plate into the soil after the respective leg is tensioned, and inserting the second peg through an opening in the second anchoring plate into the soil after the respective leg is tensioned.

7. The method according to claim 1, wherein the strip is cut at the first location before the strip is tensioned, or the strip is cut at the first location before the strip is fed through another connection point at the facing element.

8. The method according to claim 1, wherein the strip is pulled simultaneously at the first location and at the second location with substantially equal force.

9. The method according to claim 1, wherein after installation of the strip in the soil, the strip forms a V or U shape when seen from above so that a base of the V or U is at the facing element.

10. The method according to claim 9, wherein two or more V or U-shaped strips are connected in series before the strip is cut at the first location.

11. A tensioning device for installing and tensioning a reinforcement strip in a soil retained by a facing element together with the reinforcement strip extending between the facing element and an anchorage zone located away from the facing element and separated from the facing element, the device comprising: means for connecting the reinforcement strip to the tensioning device at a first location in the anchorage zone of the soil, the reinforcement strip extending from the first location to a connection point at the facing element, wherein a section of the reinforcement strip from the first location to the connection point forms a first leg; means for connecting the reinforcement strip looped from the connection point at the facing element to the tensioning device in a second location in the anchorage zone, wherein a section of the reinforcement strip from the connection point to the second location forms a second leg; and a reinforcement strip tensioner for tensioning the reinforcement strip by pulling the reinforcement strip to a predetermined tension at the first location and at the second location so that the first leg and the second leg have substantially the same tension.

12. The tensioning device according to claim 11, further comprising means for anchoring the strip to the soil at the first location and at the second location by driving an anchoring element into the soil.

13. The tensioning device according to claim 11, further comprising means for aligning and locating the tensioning device with reference to the facing element.

14. The tensioning device according to claim 11, further comprising a strip cutter for cutting the strip.

15. The tensioning device (201) according to claim 11, further comprising means for exerting a force on an anchoring peg used for anchoring the strip into the soil.

* * * * *